US012781460B2

(12) United States Patent
Auray et al.

(10) Patent No.: US 12,781,460 B2
(45) Date of Patent: Nov. 3, 2026

(54) SOIL REINFORCEMENT STRIP AND GRID

(71) Applicants: NV Bekaert SA, Zwevegem (BE); SOLETANCHE FREYSSINET, Rueil Malmaison (FR)

(72) Inventors: Germain Auray, Les Avenieres Veyrins-Thuellin (FR); André Lins, Zwevegem (BE); Ko Cattoor, Oostkamp (BE); Bart Allaert, Deinze (BE); Matthieu Aressy, Saint Ouen (FR); Nicolas Freitag, Le Vesinet (FR); Yassine Bennani Braouli, Croissy-sur-Seine (FR)

(73) Assignees: NV BEKAERT SA, Zwevegem (BE); SOLETANCHE FREYSSINET, Rueil Malmaison (FR)

( * ) Notice: Subject to any disclaimer, the term of this patent is extended or adjusted under 35 U.S.C. 154(b) by 56 days.

(21) Appl. No.: 18/034,494

(22) PCT Filed: Nov. 3, 2021

(86) PCT No.: PCT/EP2021/080566
§ 371 (c)(1),
(2) Date: Apr. 28, 2023

(87) PCT Pub. No.: WO2022/096538
PCT Pub. Date: May 12, 2022

(65) Prior Publication Data

US 2023/0399810 A1 Dec. 14, 2023

(30) Foreign Application Priority Data

Nov. 3, 2020 (EP) ..... 20290074

(51) Int. Cl.
*E02D 29/02* (2006.01)
*E02D 17/20* (2006.01)

(52) U.S. Cl.
CPC ..... *E02D 29/0233* (2013.01)

(58) Field of Classification Search
CPC ..... E02D 29/0233; E02D 29/0241
See application file for complete search history.

(56) References Cited

U.S. PATENT DOCUMENTS 3,421,326 A 1/1969 Viidal
5,839,264 A * 11/1998 Uchio ..... D07B 1/0613 57/902

(Continued)

FOREIGN PATENT DOCUMENTS

CN 206359971 7/2017
EP 0790349 A1 * 8/1997 ..... D07B 5/12

(Continued)

OTHER PUBLICATIONS

International Search Report and Written Opinion of the International Searching Authority issued Mar. 7, 2022, in International (PCT) Application No. PCT/EP2021/080566.

*Primary Examiner* — Amber R Anderson
*Assistant Examiner* — Stacy N Lawson
(74) *Attorney, Agent, or Firm* — Wenderoth, Lind & Ponack, L.L.P.

(57) ABSTRACT

A soil reinforcement strip (10, 30) for mechanically stabilizing earth structures. The strip (10, 30) has a polymer matrix (12, 32) which envelops elongated steel elements (14, 34) for reinforcing the matrix (12, 32). The steel elements (14, 34) may be steel cords containing a plurality of steel filaments (20, 22, 40, 42). Additionally, a reinforcement grid (60) for soil and ground. Furthermore, applications of this reinforcement strip (10, 30) and grid (60), namely to a reinforced soil layer (80) and to a mechanically stabilized earth structure or retaining wall (82).

26 Claims, 3 Drawing Sheets

(56) References Cited

U.S. PATENT DOCUMENTS

| | | | | |
|---|---|---|---|---|
| 5,890,843 | A * | 4/1999 | Bastick | E04C 5/03 405/262 |
| 2006/0116040 | A1 | 6/2006 | Yun et al. | |
| 2009/0123238 | A1* | 5/2009 | Morizot | E02D 29/0241 405/302.4 |
| 2010/0254770 | A1* | 10/2010 | Morizot | E02D 17/202 405/302.4 |
| 2017/0009420 | A1 | 1/2017 | Nait-Ali et al. | |
| 2020/0369837 | A1* | 11/2020 | Parsekar | D07B 1/0666 |

FOREIGN PATENT DOCUMENTS

| | | |
|---|---|---|
| EP | 3 099 860 | 2/2018 |
| FR | 1393988 | 4/1965 |
| KR | 1194309 B1 * | 10/2012 |
| WO | 95/11351 | 4/1995 |
| WO | 2019/158398 | 8/2019 |

* cited by examiner

SOIL REINFORCEMENT STRIP AND GRID

TECHNICAL FIELD

The invention relates to a soil reinforcement strip for mechanically stabilized earth structures.

The invention also relates to a reinforcement grid for soil and ground. Furthermore, the invention also relates to applications of this reinforcement strip and grid, namely to a reinforced soil layer and to a mechanically stabilized earth structure or retaining wall.

BACKGROUND ART

Improved mechanically stabilized earth structures and reinforced soil layers already date back from the French patent FR 1 393 988 of Henri Vidal where the basic principle of soil stability and reinforcement was disclosed and explained. Fill material and reinforcement elements form a stable equilibrium based upon the simple principle of friction of the fill material with the reinforcement elements or within the fill material that is in contact with the reinforcement elements.

By way of example, a mechanically stabilized earth structure comprises a facing in the form of prefabricated concrete blocks, metal welded lattice panels, or woven or welded gabions of metal wires. The facing has connectors for connecting soil reinforcement strips to the facing. These soil reinforcement strips extend at one side of the facing and provide stability to the fill material that is provided at the one side of the facing.

The service life of these retaining walls is expected to be between 75 years and 120 years. Hence, huge demands are required from the soil reinforcement strips. Firstly, the strips must provide the required friction to give stability to the fill material. Secondly, the strips must provide the required tensile strength and elongation for wall stability. Thirdly, the soil reinforcement strips must have a long service life time, i.e. they must be highly corrosion resistant since the fill material can be aggressive. Fourthly, the soil reinforcement strips must be resistant to damage possibly caused by the layout and compaction inside the backfill material.

EP-B1-3 099 860 of Terre Armée Internationale discloses a soil reinforcement strip having a polymer matrix and reinforcement fibres inside. In order to improve the adhesion between the reinforcement fibres and the polymer matrix, the polymer is at least partially functionalised, more particularly the polymer comprises a functionalised polyolefin.

DISCLOSURE OF INVENTION

A general object of the invention is to avoid or at least to mitigate the disadvantages of the prior art.

A particular object of the invention is to provide a further improvement to the soil reinforcement strips.

A more particular object of the invention is to provide improved reinforcement elements for the reinforcement strips.

Still another object of the present invention is to increase for example the stiffness, the durability and/or service life of a reinforcement strip.

According to a first aspect of the present invention, there is provided a soil reinforcement strip, for example, for mechanically stabilized earth structures. The strip has a polymer matrix and further comprises elongated steel elements inside the polymer matrix as reinforcing elements. The elongated steel elements have a combined elastic and plastic elongation at break that exceeds 4%, for example 4.5%, 5% or even 6%. and/or further preferred stays below 15%, further preferred stays below 12%, further preferred stays below 10%. This may contribute for example to an efficient mechanical stabilization of earth as well as to allow structures to settle at least to some extend and/or allow some displacement of any facing or facing elements during use to help visually diagnose any problems and correspondingly plan maintenance, while at the same time helping to avoid total failure, especially from facing elements toppling over or falling and/or from the embankment crumbling.

In an embodiment, the invention may especially for example concern a soil reinforcement strip, said strip having a polymer matrix, said strip further comprising elongated steel elements inside said polymer matrix as reinforcing elements, each of said elongated steel elements having a combined elastic and plastic elongation at break that exceeds 4%, wherein said elongated steel elements are steels cord or comprise at least one steel cord having steel filaments, wherein further at least one elongated steel element or each elongated steel elements comprises a plurality of steel filaments, wherein the steel filaments have a twisted configuration such that helical interstices are formed between at least some of the steel filaments at a periphery of the at least one steel cord, wherein polymer material of the matrix penetrates into the helical interstices. This may further contribute to efficient stabilization by improving coupling and/or load transfers between the polymer matrix and the elongated steel elements.

In an embodiment, the invention may especially for example also concern a soil reinforcement strip, said strip having a polymer matrix, said strip further comprising elongated steel elements inside said polymer matrix as reinforcing elements, each of said elongated steel elements having a combined elastic and plastic elongation at break that exceeds 4%, wherein said elongated steel elements have a cord tensile strength or tensile strength of at least 1800 MPa, preferably at least 2000 MPa, most preferably at least 2200 MPa, further preferred at least above 2500 MPa and/or further preferred below 4500 Mpa and/or wherein further said elongated steel elements or at least one of said elongated steel elements may be in a stress-relieved state. This may further contribute to efficient mechanical stabilization, especially in view of the high modulus and/or high tensile strength of steel, in combination with a high elegation that may allow soil or embankment structures to settle at least to some extend, as needed, and/or allow some displacement of facing elements during use to help visually diagnose any problems and correspondingly plan maintenance, while at the same time helping to avoid total failure, especially from facing elements toppling over or falling and/or from the embankment crumbling.

In an embodiment, the invention may especially for example further concern a soil reinforcement strip, said strip having a polymer matrix, said strip further comprising elongated steel elements inside said polymer matrix as reinforcing elements, each of said elongated steel elements having a combined elastic and plastic elongation at break that exceeds 4%, wherein further at least one elongated steel element or each elongated steel elements comprises a plurality of steel filaments, wherein the steel filaments have a twisted configuration such that helical interstices are formed between at least some of the steel filaments at a periphery of the at least one steel cord, wherein polymer material of the matrix penetrates into the helical interstices. and wherein said elongated steel elements have a cord tensile strength or tensile strength of at least 1800 MPa, preferably at least 2000 MPa, most preferably at least 2200 MPa, further preferred at least above 2500 MPa and/or further preferred below 4500 Mpa and/or wherein said elongated steel elements or at least one of said elongated steel elements may be in a stress-relieved state. This may also further contribute to increase coupling and/or load transfers between the polymer matrix and the steel cords, so as to benefit as much as possible of the properties, especially for example modulus and/or tensile strength, of the steel for efficient stabilization.

The elongated steel elements may be stainless steel elements or carbon steel elements. The carbon steel elements may be coated with a material providing cathodic protection, for example, they are coated with zinc or with a zinc alloy to increase the resistance against corrosion. Alternatively, or in addition, the elongated steel elements may be in contact with a material providing cathodic protection.

The use of these elongated steel elements has a number of advantages. First of all, one is be able to benefit of the high tensile stiffness of steel material at low elongation. As a result, low elongation can be maintained during the construction and normal life of the structure. Secondly, enough ductility is kept at break in case of unexpected event on the structure approaching higher movement or failure, especially to avoid sudden failure. Steel in the sense of the present invention may thereby preferably have a nickel content <17 wt-% preferably below 15 wt-%, further below 10 wt-%, even further preferred below 5 wt-% and/or a manganese content <9 wt-%, preferably below 7 wt-%, further preferred below 5 wt-%. Steel may thereby especially for example have a Young's modulus between 180 and 200 GPa. The use of steel may thereby further contribute to reduce problems with creep, especially when physically and/or chemically coupled to the matrix.

As will be explained hereinafter, the structural elongation is not included in the combined elastic and plastic elongation at break.

The elongated steel elements may be steel wires.

Most preferably, however, the elongated steel elements are steel cords or comprise at least one steel cord, preferably for example comprising steel filaments that are individually coated with zinc or with a zinc alloy and that are twisted together to form the steel cord. A steel cord may have the same reinforcing effect of a steel wire while being much more flexible. A steel cord may thereby been assembled from drawn filaments, whereby especially for example the heat of the drawing may influence the crystalline structure and properties of the steel.

The elongated steel elements have been preferably stress-relieved in order to reach the minimum elastic and plastic elongation. Stress-relieving the elongated steel elements is done by heating the steel cords to a temperature above 400° C. In doing so, the crystalline structure of the steel may be influenced and the tensile strength of an elongated steel element may drop for example by somewhat more than 10% but at the same time, the plastic elongation will increase very significantly so that the sum of elastic elongation and plastic elongation may exceed 4%, especially at still high values of tensile strength. Steel cords with a high tensile strength or a high cord tensile strength of for example 3000 MPa but with a very low elongation at break may thereby be assembled from drawn steel filaments. Upon stress relieving the tensile strength or a cord tensile strength may for example decrease to about 2600 MPa, while the plastic elongation increases significantly, especially to above a value for an equivalent cord with a tensile strength or a cord tensile strength of for example about 2600 MPa, so that the sum of elastic elongation and plastic elongation may exceed 4%. This may particularly contribute for example to achieve high elongation at break and high cord tensile strength or tensile strength.

In case of steel cords, the preferred steel cords are single strand cords that can be made in one single twisting operation and with a limited number of steel filaments, e.g. between two and seven. Most preferably, the steel cords have an open construction, i.e. that polymer of the polymer matrix contacts all steel filaments and, ideally, surrounds all steel filaments individually. A full penetration of the polymer inside the steel cord and good adherence of the polymer to the steel cord is a guarantee for excellent corrosion resistance and prevents water or moisture from travelling along the length of the steel cord. Adhesion between the polymer matrix and the steel cords may be thereby also be improved for example by physical or chemical coupling for example using surface physical or chemical surface treatments and/or chemical agents such as glues, primers or adhesion promotors. This may further contribute to improve the coupling and/or load transfers between the polymer matrix and the steel cords, so as to help with mechanical stabilization. In an embodiment, at least one of the elongated steel elements or each elongated steel element may thereby comprise for example a plurality of steel filaments, wherein the steel filaments have a twisted configuration such that helical interstices are formed between at least some of the steel filaments at a periphery of the at least one of the elongated steel elements, wherein polymer material of the matrix penetrates into the helical interstices. In an embodiment, the at least one of the elongated steel elements or each elongated steel element may comprise for example a central steel filament and peripheral steel filaments stranded around the central steel filament. In an embodiment, the helical interstices at the periphery of the at least one of the elongated steel elements or each elongated steel element may reach the central steel filaments. In an embodiment, the peripheral steel filaments may be between 3 and 9, preferably between 3 and 6, peripheral steel filaments. In an embodiment, the central steel filament may have a diameter larger than at least some or all of the peripheral steel filaments. In one embodiment, the at least one of the elongated steel elements or each elongated steel element is made of a group of at least two steel filaments twisted together as a group. In one embodiment, the/said group may have at most 5 steel filaments. The use of steel cords, especially with multiple strands or filaments, which may allow for the polymer to penetrate inside the steel cords, may thereby further contribute to improve coupling and/or load transfers between the polymer matrix and the steel cords, especially by allowing the polymer to be thereby physically coupled to the steel cords in a very durable way, so as to help with mechanical stabilization, especially when in use for a very extended time period of many years.

Examples of single strand cords that offer good polymer penetration may be:

- n×1 cord, where n is the number of steel filaments and ranges between 2 and 5, preferably between 3 and 5, the steel filaments have been plastically deformed so that they not always contact each other and allow polymer penetration;

2×1 cord, a cord consisting of two steel filaments;

1+n cord, i.e. a cord with a single steel filament as core and n steel filaments in a layer surrounding the single core steel filament, n may range from 3 to 9, but is usually limited from 3 to 6; a layer that is not saturated enhances polymer penetration. In an embodiment, the cord(s) is/are selected from the group of:

n×1 cord(s), where n is the number of steel filaments and ranges between 2 and 5, preferably 3 and 5;

2×1 cord(s);

1+n cord(s) where n ranges from 3 to 9, preferably from 3 to 6 or the elongated steel elements comprise at least one cord selected from the group of:

n×1 cord(s), where n is the number of steel filaments and ranges between 2 and 5;

1+n cord(s) where n is a number of steel filaments arranged around a central steel filament and ranges from 3 to 9, preferably from 3 to 6.

Preferably the elongated steel elements have a cord tensile strength or tensile strength above 1800, e.g. above 2000 MPa, most preferably above 2200 MPa, e.g. above 2500 MPa and/or below 4500 MPa. Such high values may thereby be unusual for steel, especially in combination with a high elongation at break that exceeds 4%, since elongation at break usually significantly decreases to very low levels as cord tensile strength or tensile strength increases. This may contribute for example to an efficient mechanical stabilization of earth, especially by the high modulus and/or high tensile strength of steel.

The soil reinforcement strip may comprise between 5 and 50 steel cords or steel wires, e.g. between 10 and 45 steel cords or steel wires, e.g. between 15 and 40 steel cords or steel wires, further preferred between >15 and <30 steel cords or steel wires. In an embodiment, the steel cords or steel wires are arranged inside the polymer matrix parallel to each other, preferably in a way that they do not touch each other. This may contribute to help to prevent propagation of corrosion and/or failure of steel cords or steel wires. In an embodiment, the steel cords or steel wires may be arranged inside the polymer matrix in one plane or in multiple planes, especially for example in 2, 3 or 4 planes. In an embodiment the thickness of the polymer matrix between any point at the outside of the strip and any steel cord or steel wire inside the strip is at least 100 μm, preferably between >100 μm and <500 μm, further preferred between 150 μm and 400 μm, further preferred between 160 μm and 350 μm, further preferred between 175 μm and 300 μm. This may contribute to help to prevent corrosion and/or failure of steel cords or steel wires. In an embodiment, wherein the dimension of the outline of cross-section of the matrix in one direction is bigger than the dimension of cross-section of the matrix in another perpendicular direction, preferably wherein the outline of cross-section of the matrix may thus be for example oval, rectangular or corresponds to a rectangle with rounded corners. This may help to further increase the drag on the strips and thus also for example further contribute to mechanical stabilization of earth.

In order to increase the adhesion between the polymer and the elongated steel elements, the polymer matrix may comprise, at least partially, a functionalised polyolefin like especially for example HDPE (high density polyethylene), modified polypropylene and low-density polyethylene (LDPE), linear low density polyethylene (LLDPE), very low density polyethelene (VLDPE), ultra low density polyethylene (ULDPE) and/or ethylene based copolymers like for example ethylene-propylene copolymers, ethylene-vinyl acetate copolymers (EVA) or acrylate copolymers, especially for example modified, grafted or comprising some polar function like acrylate or acetate functions. In case of partial functionalisation and/or the matrix partially comprising other materials, the functionalised polyolefin is in contact with the steel cords. This may thereby further contribute to increase coupling and/or load transfers between the polymer matrix and elongated steel elements, so as to help with mechanical stabilization.

In addition to the functionalised polyolefin, or as an alternative, the elongated steel elements may be provided with a primer or an adhesion promotor.

In a preferable embodiment of the invention, the steel elements, especially for example the steel wire or the steel cord, may be individually or together coated in advance with a thin layer of a polymer that is a functionalized polyolefin or individually or together provided with a primer or adhesion promotor before all the steel wires or the steel cords are together extruded with a common, non-functionalized polymer.

A good adhesion is needed to protect the elongated steel elements from external damage and to maximize the durability.

The soil reinforcement strip may have a strip breaking load ranging from 1 kN to 200 kN, e.g. ranging from 2 kN to 100 kN, preferably ranging for example from 10 kN to 150 kN, further preferred from 20 kN to 125 kN, even further preferred from 30 kN to 110 kN, even further preferred from 50 kN to 105 kN.

According to a second aspect of the present invention, the invention relates to a grid for soil reinforcement. This grid comprises a set of first strips in a first direction and a set of second strips in a second direction. The set of first strips and the set of second strips cross one another and are bonded or fixed to each other, e.g. by slightly heating the strips so that the polymer matrixes adhere to each other, or by means of a glue or a hot melt, or by means of stitching. The set of first strips or the set of second strips or both the set of first strips and the set of second strips may be reinforced strips according to the first aspect of the invention.

The invention strip and the invention grid can be used as reinforcement for a reinforced soil layer.

The invention strip and the invention grid can be used as reinforcement in a mechanically stabilized earth structure.

In an embodiment, one or more strip(s) may be for example arranged to be connected or may be connected to at least one facing element, preferably stabilizing earth and/or arranged to be part of an embankment, further preferred a concrete block or a gabion, especially for example so that forces exerted on the facing and/or embankment can at least partially be counter acted by drag on the strip(s). This may allow the strip(s) to contribute to mechanically stabilize the earth and/or the facing and/or the embankment.

BRIEF DESCRIPTION OF FIGURES IN THE DRAWINGS

MODE(S) FOR CARRYING OUT THE INVENTION

Figure 1:
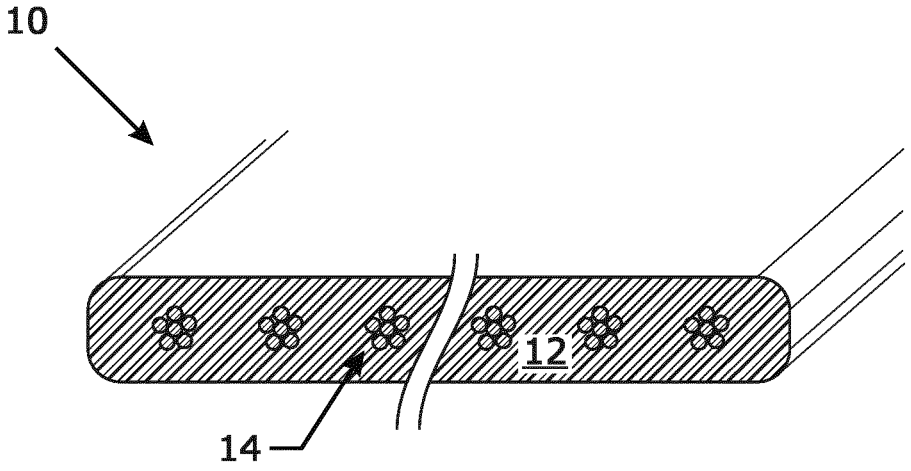
FIG. 1 illustrates a first strip.

FIG. 1 illustrates a first soil reinforcement strip 10 according to the invention. The strip 10 has a polymer matrix 12 and between ten and fifty steel cords 14.

Suitable and preferable polymers or functionalised polymers for the polymer matrix 12 may be for example polyolefins such as grafted and/or blended HDPE (high density polyethylene), modified polypropylene and low-density polyethylene (LDPE), linear low density polyethylene (LLDPE), very low density polyethelene (VLDPE), ultra low density polyethylene (ULDPE) and/or ethylene based polymers or copolymers like for example ethylene-propylene copolymers, ethylene-vinyl acetate copolymers (EVA) or acrylate copolymers, especially for example modified, grafted or comprising some polar function like acrylate or acetate functions.

The strip 10 may have a width ranging from 5 mm or 10 mm to 80 mm, preferably 20 mm to 70 mm. Especially in case of a grid, the width of the strips for example may be less than 20 mm. The strip 10 may have a thickness ranging from 2 mm to 4 mm.

Figure 2:
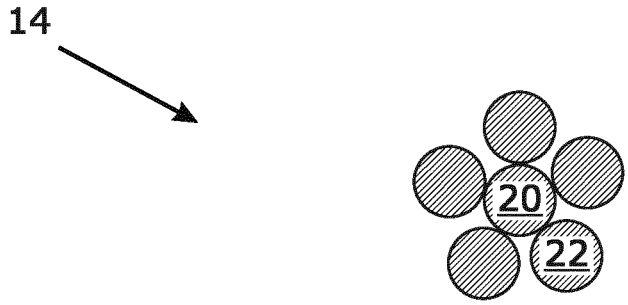
FIG. 2 shows a cross-section of a first example of a steel cord.

Referring to FIG. 2, the steel cord 14 is a (1+5)×0.37 steel cord having a core filament 20 with a diameter of 0.37 mm and five layer filaments 22 with a diameter of 0.37 mm twisted around the core filament and forming an unsaturated layer around the core filament 20. An unsaturated layer means that the layer is not closed, i.e. the layer filaments 22 do not contact one's neighbour and allow polymer to penetrate and adhere to the core filament 20. The unsaturated layer not only allows mechanical anchorage of the polymer to the steel cord 14 but also increased chemical adhesion as the contact surface between steel and polymer has increased substantially.

Alternative steel cords may be provided that also have a construction with one or more core filaments and an unsaturated layer.

An example is a $1\times d_1+6\times d_2$ construction where the diameter $d_2$ of the layer filaments is smaller than the diameter $d_1$ of the core filament. Another example is a $1\times d_1+4\times d_2$ construction with the diameter $d_1$ of the core filament equal or somewhat thicker than the diameter $d_2$ of the layer filaments.

The steel filaments of the steel cords preferably have a zinc or a zinc alloy coating. Most preferably, the zinc or zinc alloy coating is applied to the steel filaments by way of a hot dip operation. The thickness of the zinc coating may be smaller than four micrometer, e.g. lower than three micrometer. Preferably an alloy layer zinc-steel is present between the steel core and the zinc or zinc alloy coating. This zinc or zinc alloy coating is added to the steel wires or the steel filaments of the steel cord before any extrusion with a polymer or before any treatment with a primer or adhesion promotor.

A zinc alloy coating may be a zinc aluminium coating that has an aluminium content ranging from 2 percent by weight to 12 percent by weight, e.g. ranging from 3% to 11%.

A preferable composition lies around the eutectoid position: Al about 5 percent. The zinc alloy coating may further have a wetting agent such as lanthanum or cerium in an amount less than 0.1 percent of the zinc alloy. The remainder of the coating is zinc and unavoidable impurities.

Another preferable composition contains about 10% aluminium. This increased amount of aluminium provides a better corrosion protection then the eutectoid composition with about 5% of aluminium.

Other elements such as silicon (Si) and magnesium (Mg) may be added to the zinc aluminium coating. With a view to optimizing the corrosion resistance, a particular good alloy comprises 2% to 10% aluminium and 0.2% to 3.0% magnesium, the remainder being zinc.

An example is 5% Al, 0.5% Mg and the rest being Zn.

Figure 3:
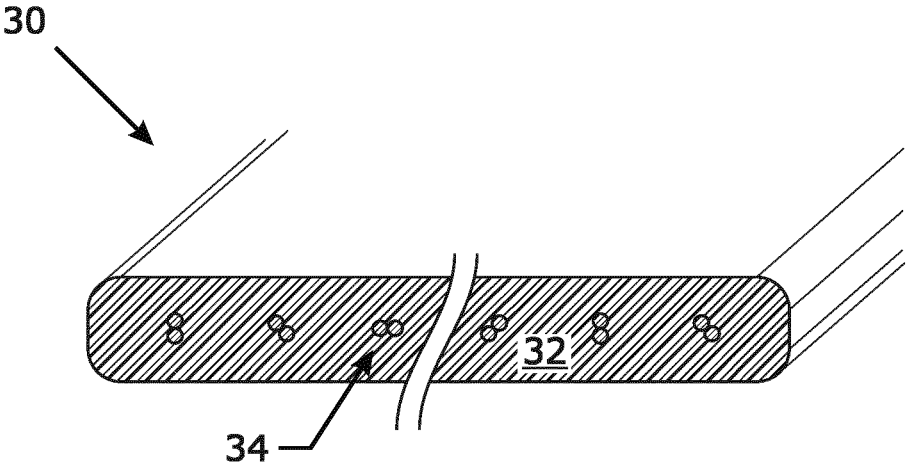
FIG. 3 illustrates a second strip.

FIG. 3 illustrates a second soil reinforcement strip 30 according to the invention. The soil reinforcement strip has a polymer matrix 32 and is reinforced by various steel cords 34.

Figure 4:
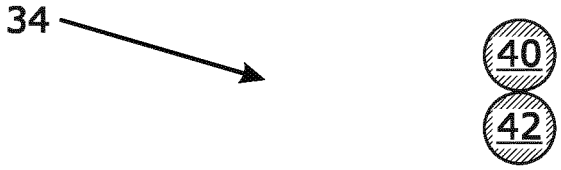
FIG. 4 shows a cross-section of a second example of a steel cord.

FIG. 4 shows a cross-section of a steel cord 34. Steel cord 34 has a 2×1 construction, i.e. steel cord 34 consists of two steel filaments 40, 42 that have been twisted with each other. An example is 2×0.54 (filament diameter 0.54 mm).

Other n×1 steel cord constructions may be provided with n the number of steel filaments and ranging from three to where nine. One or more of the steel filaments has a plastic deformation, for example an undulation, to avoid that all n steel filaments contact one another and form and enclose a central cavity where polymer would not be able to penetrate.

Figure 5:
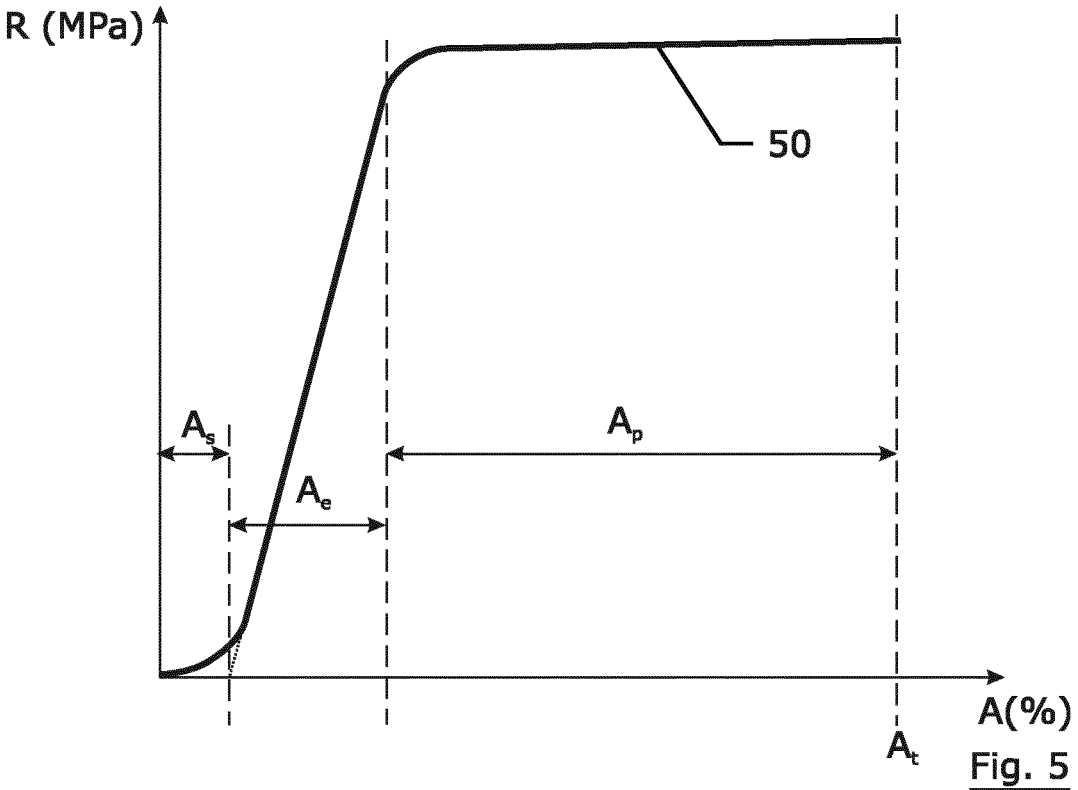
FIG. 5 shows a load—elongation curve of a steel cord.

FIG. 5 shows a load elongation curve 50 of a steel cord used in the context of the present invention. The abscissa is the elongation A, expressed in percent. The ordinate is the load R, expressed in MPa.

At small initial loads steel cord constructions may show in some cases a relatively large elongation $A_s$, referred to as the structural elongation. This is the first phase. The structural elongation $A_s$ of the steel cord is that part of the elongation that is due to the twisted nature of the cord or due to plastic preformation of the individual steel wires. The cord is somewhat stretched, filaments come closer to each other and the twisting pitch increases somewhat. In case of an individual steel wire, the steel wire is stretched and becomes straight.

It is not necessary that this structural elongation is avoided. In some cases it may be useful to obtain a complete penetration by the polymer inside the steel cord.

In a second phase, the steel filaments in the steel cord show an elastic elongation $A_e$. That part is the linear part according to Hooke's law.

In a third phase, the steel filaments are plastically deformed over an elongation $A_p$ until the steel cord breaks at an elongation of $A_t$.

According to the present invention, the sum of the elastic elongation $A_e$ and the plastic elongation $A_p$ must exceed 4%, e.g. is more than 4.5%, e.g. more than 5%. The structural elongation $A_s$, if any, must not be added, since this structural elongation gets lost due to embedment of the steel cord in the polymer matrix.

Figure 6:
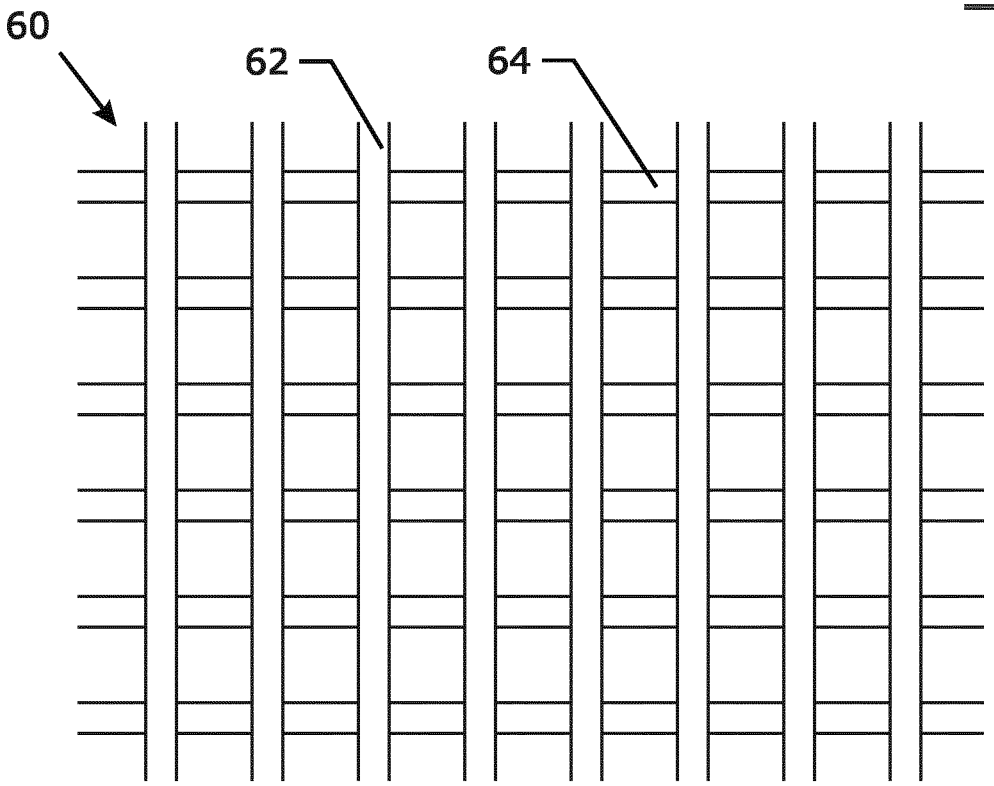
FIG. 6 shows a first grid.

FIG. 6 shows a first example of a soil reinforcement grid 60, sometimes called a geogrid, according to the present invention. Grid 60 comprises a number of strips 62 in one direction and a number of strips 64 in another direction, e.g. preferably perpendicular to the direction of strips 62 although other embodiments are possible with angles different from 90°. Strips 62 may form the warp and strips 64 the weft. The strips 62, or the strips 64, or both the strips 62 and the strips 64 may be reinforcement strips according to the invention. The strips 62 are superimposed upon the strips 64. Strips 62 may be fixed to strips 64 by a heat operation like hot welding so that the polymers melt partially and adhere to each other. Another way of fixing strips 62 to strips

64 is by adhesive bonding, or by mechanical fixing by means of textile yarns forming stitches.

Figure 7:
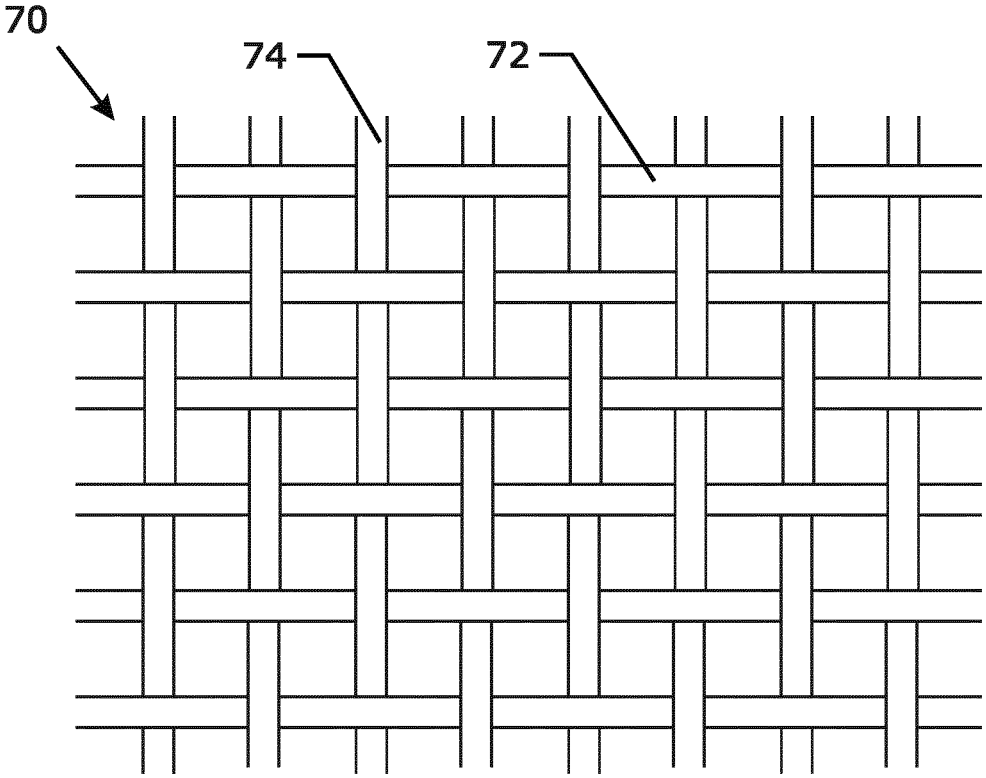
FIG. 7 shows a second grid.

FIG. 7 shows another example of a grid 70 having strips 72 in one direction and strips 74 in another direction. The difference with the embodiment of FIG. 6 is now that the strips 72 are interwoven with strips 74.

Figure 8:
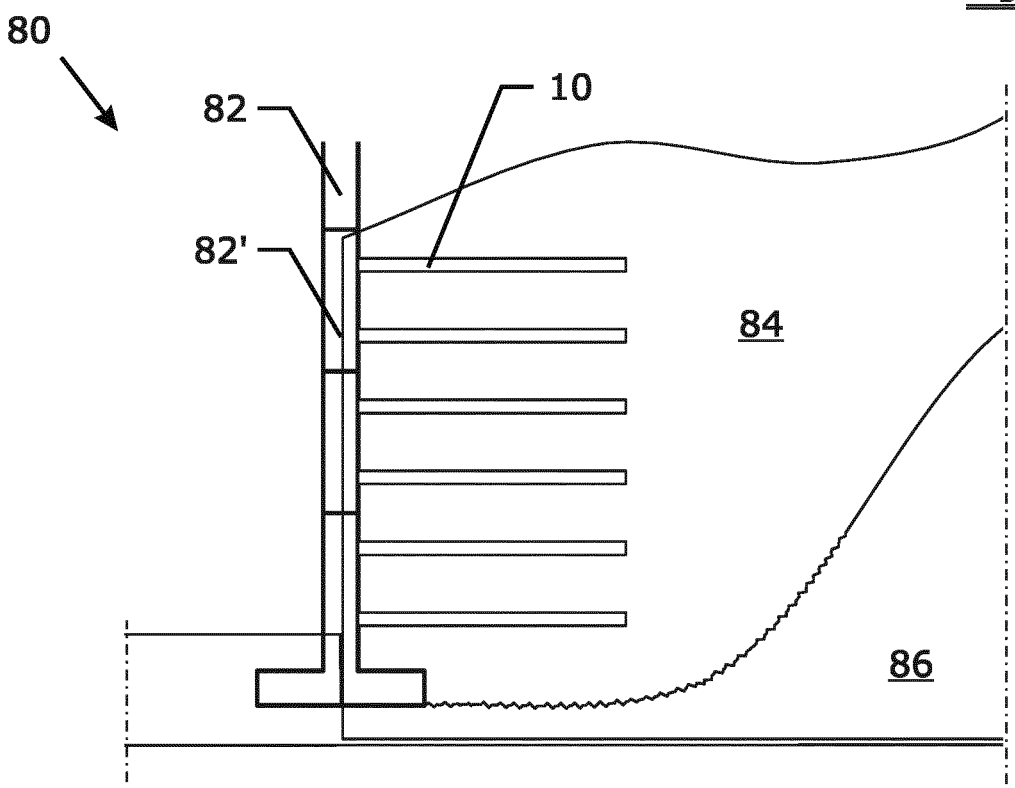
FIG. 8 illustrates a mechanically stabilized earth structure.

FIG. 8 illustrates how strips 10 are used in a mechanically stabilized earth structure 80. The embankment structure 80 has a facing that may be composed of prefabricated concrete blocks 82, 82' that are positioned one upon the other. Alternative facings may be constructed with welded or woven steel wire gabions. Strips 10 are connected to the facing 82, 82' one by one, starting with the lowest level. Fill material 84 is gradually added and loaded. The fill material 84 may comprise sand, gravel, soil, crushed rocks, recycled materials from demolition of buildings or civil engineering structures, lime, cement.

LIST OF REFERENCE NUMBERS

10 strip
12 polymer matrix
14 steel cord
20 core steel filament
22 layer steel filament
30 strip
32 polymer matrix
34 steel cord
40 steel filament
42 steel filament
50 load— elongation curve
60 grid
62 strip
64 strip
70 grid
72 strip
74 strip
80 mechanically stabilized earth structure
82, 82' building blocks of the facing
84 fill material
86 natural ground

The invention claimed is:

1. A soil reinforcement strip,
said strip comprising a polymer matrix,
said strip further comprising elongated steel elements inside said polymer matrix as reinforcing elements,
wherein each of said elongated steel elements has a combined elastic and plastic elongation at break that exceeds 4% and a tensile strength of at least 1800 MPa,
wherein said elongated steel elements are steel cords consisting of steel filaments, and
wherein the soil reinforcement strip is a flat soil reinforcement strip configured to mechanically stabilize an earth structure.

2. The strip according to claim 1,
wherein the steel filaments of each elongated steel element have a twisted configuration such that helical interstices are formed between at least some of the steel filaments at a periphery of the at least one of the elongated steel elements, wherein polymer material of the matrix penetrates into the helical interstices.

3. The strip according to claim 2,
wherein the steel filaments of each elongated steel element comprise a central steel filament and peripheral steel filaments stranded around the central steel filament.

4. The strip according to claim 3,
wherein the helical interstices at the periphery of the at least one of the elongated steel elements or each elongated steel element reach the central steel filaments.

5. The strip according to claim 3,
wherein the peripheral steel filaments are between 3 and 9 peripheral steel filaments.

6. The strip according to claim 3,
wherein the central steel filament has a diameter larger than at least some of the peripheral steel filaments.

7. The strip according to claim 3,
wherein the peripheral steel filaments are between 3 and 6 peripheral steel filaments.

8. The strip according to claim 2,
wherein the at least one of the elongated steel elements or each elongated steel element is made of a group of at least two steel filaments twisted together as a group.

9. The strip according to claim 8,
wherein the group has at most 5 steel filaments.

10. The strip according to claim 2,
wherein the cord(s) is/are selected from the group of:
n×1 cord(s), where n is the number of steel filaments and ranges between 2 and 5;
2×1 cord(s);
1+n cord(s) where n ranges from 3 to 9,
or
wherein the elongated steel elements comprise at least one cord selected from the group of:
n×1 cord(s), where n is the number of steel filaments and ranges between 2 and 5;
1+n cord(s) where n is a number of steel filaments arranged around a central steel filament and ranges from 3 to 9.

11. The strip according to claim 2,
wherein all of said steel filaments are in contact with polymer of said polymer matrix.

12. The strip according to claim 2,
wherein said polymer material comprises a functionalised polyolefin and/or ethylene based polymers or copolymers.

13. The strip according to claim 2,
wherein the cord(s) is/are selected from the group of:
n×1 cord(s), where n is the number of steel filaments and ranges between 3 and 5;
2×1 cord(s);
1+n cord(s) where n ranges from 3 to 6,
or
wherein the elongated steel elements comprise at least one cord selected from the group of:
n×1 cord(s), where n is the number of steel filaments and ranges between 2 and 5;
1+n cord(s) where n is a number of steel filaments arranged around a central steel filament and ranges from 3 to 6.

14. The strip according to claim 2,
wherein said polymer material comprises a functionalised polyolefin selected from grafted and/or blended HDPE (high density polyethylene), modified polypropylene and low-density polyethylene (LDPE), linear low density polyethylene (LLDPE), very low density polyethelene (VLDPE), ultra low density polyethylene (ULDPE) and/or ethylene based polymers or copolymers selected from ethylene-propylene copolymers, ethylene-vinyl acetate copolymers (EVA) or acrylate copolymers.

15. The strip according to claim 1, wherein said elongated steel elements are coated with a material providing cathodic protection and/or wherein the strip comprises at least 2 of the steel cords and/or wherein the steel cords are arranged inside the polymer matrix parallel to each other and/or wherein the steel cords are arranged inside the polymer matrix in one plane or in multiple planes and/or wherein the thickness of the polymer matrix between any point at the outside of the strip and any steel cord inside the strip is at least 100 μm and/or wherein the dimension of the outline of cross-section of the matrix in one direction is bigger than the dimension of cross-section of the matrix in another perpendicular direction and/or wherein the strip is arranged to be connected to or the strip is connected to at least one facing element and/or arranged to be part of an embankment and/or wherein said elongated steel elements have a combined elastic and plastic elongation at break that is more than 4.5% and/or wherein the strip has a width between 5 mm and 80 mm.

16. The strip according to claim 1, wherein said elongated steel elements are in contact with a material providing cathodic protection.

17. The strip according to claim 1, wherein said elongated steel elements are of stainless steel.

18. The strip according to claim 1, wherein said elongated steel elements or at least one of said elongated steel elements are/is in a stress-relieved state.

19. The strip according to claim 1, wherein said elongated steel elements are provided with an adhesion promotor and/or wherein said elongated steel elements are individually or together coated with a layer of a polymer that is a functionalized polyolefin or individually or together provided with a primer or adhesion promotor before all the steel cords are together extruded with a common, non-functionalized polymer.

20. The strip according to claim 1, wherein said strip has a strip breaking load ranging from 1 kN to 200 kN.

21. The strip according to claim 1, wherein said elongated steel elements are coated with a material providing cathodic protection and/or wherein the strip comprises at least 3 of the steel cords and/or wherein the steel cords are arranged inside the polymer matrix parallel to each other in a way that they do not touch each other and/or wherein the steel cords are arranged inside the polymer matrix in 2, 3 or 4 planes and/or wherein the thickness of the polymer matrix between any point at the outside of the strip and any steel cord inside the strip is between 100 μm and 500 μm and/or wherein the dimension of the outline of cross-section of the matrix in one direction is bigger than the dimension of cross-section of the matrix in another perpendicular direction, wherein the outline of cross-section of the matrix is oval, rectangular or corresponds to a rectangle with rounded corners and/or wherein the strip is arranged to be connected to or the strip is connected to stabilizing earth and/or arranged to be part of a concrete block or a gabion and/or wherein said elongated steel elements have a combined elastic and plastic elongation at break that is more than 5% and/or wherein the strip has a width between 10 mm and 80 mm.

22. The strip according to claim 1, wherein said elongated steel elements have a cord tensile strength or tensile strength of at least 2000 MPa.

23. The strip according to claim 1, wherein said strip has a strip breaking load ranging from 10 kN to 150 kN.

24. A grid for soil reinforcement, said grid comprising a set of first strips in a first direction and a set of second strips in a second direction, said set of first strips and said set of second strips crossing one another and being bonded to one another, said set of first strips or said set of second strips or both said set of first strips and said set of second strips having strips according to claim 1.

25. A soil reinforcement layer, said layer comprising one or more flat soil reinforcement strips or one or more grids for soil reinforcement, wherein the one or more flat soil reinforcement strips have a polymer matrix, further comprising elongated steel elements inside said polymer matrix as reinforcing elements, wherein each of said elongated steel elements has a combined elastic and plastic elongation at break that exceeds 4% and a tensile strength of at least 1800 MPa, and wherein said elongated steel elements are steel cords consisting of steel filaments, and wherein the one or more grids for soil reinforcement comprise a set of first strips in a first direction and a set of second strips in a second direction, said set of first strips and said set of second strips crossing one another and being bonded to one another, said set of first strips or said set of second strips or both said set of first strips and said set of second strips having the one or more flat soil reinforcement strips.

26. A mechanically stabilized earth structure, comprising one or more flat soil reinforcement strips, or one or more grids for soil reinforcement, wherein the one or more flat soil reinforcement strips have a polymer matrix, further comprising elongated steel elements inside said polymer matrix as reinforcing elements, wherein each of said elongated steel elements has a combined elastic and plastic elongation at break that exceeds 4% and a tensile strength of at least 1800 MPa, and wherein said elongated steel elements are steel cords consisting of steel filaments, and wherein the one or more grids for soil reinforcement comprise a set of first strips in a first direction and a set of second strips in a second direction, said set of first strips and said set of second strips crossing one another and being bonded to one another, said set of first strips or said set of second strips or both said set of first strips and said set of second strips having the one or more flat soil reinforcement strips.

* * * * *